US006575339B2

(12) United States Patent
Jourdin et al.

(10) Patent No.: US 6,575,339 B2
(45) Date of Patent: Jun. 10, 2003

(54) DISPENSER HAVING A FIXING MEMBER WITH PERIPHERAL SEALING

(76) Inventors: Gilles Jourdin, 7, rue de La Mairie, 27170 Combon (FR); Dany Ray, Route de La Cote d'Apremont, 78820 Juziers (FR)

( * ) Notice: Subject to any disclaimer, the term of this patent is extended or adjusted under 35 U.S.C. 154(b) by 0 days.

(21) Appl. No.: 09/776,180

(22) Filed: Feb. 2, 2001

(65) Prior Publication Data

US 2001/0048003 A1 Dec. 6, 2001

(30) Foreign Application Priority Data

May 31, 2000 (FR) ..... 00 07019

(51) Int. Cl.[7] ..... B65D 88/54

(52) U.S. Cl. ..... 222/321.7; 222/321.9; 222/383.7; 222/385

(58) Field of Search ..... 222/321.7, 321.6, 222/321.8, 321.9, 321.1, 321.2, 383.1, 382, 402.1, 542, 385; 220/806, 803, 795, 378; 215/352, 274, 276

(56) References Cited

U.S. PATENT DOCUMENTS 2,657,834 A * 11/1953 Bacheller ..... 222/321
3,480,169 A * 11/1969 Hammes ..... 215/40
3,502,035 A * 3/1970 Fedit et al. ..... 103/178
3,680,790 A * 8/1972 Boris ..... 239/353
3,937,366 A * 2/1976 Steinman ..... 222/321
4,056,216 A * 11/1977 Kotuby ..... 222/385
4,071,172 A * 1/1978 Balogh ..... 222/321
4,344,744 A * 8/1982 Schuster et al. ..... 417/550
4,494,674 A * 1/1985 Roof ..... 220/306
4,660,355 A * 4/1987 Kristen ..... 53/510
4,773,553 A * 9/1988 Van Brocklin ..... 215/272
4,892,232 A * 1/1990 Martin ..... 222/207
4,911,336 A * 3/1990 Blake ..... 222/321
4,984,702 A * 1/1991 Pierpont ..... 215/272
5,163,576 A * 11/1992 Galer ..... 220/308
5,255,805 A * 10/1993 Weiss et al. ..... 215/274
5,509,584 A * 4/1996 Gueret ..... 222/321.7
5,562,219 A * 10/1996 de Pous et al. ..... 215/274
5,641,089 A * 6/1997 Palank ..... 220/733
5,642,908 A * 7/1997 Mascitelli ..... 285/148.19
5,649,649 A * 7/1997 Marelli ..... 222/321.2
5,685,351 A * 11/1997 Kazarian et al. ..... 141/325
5,692,649 A * 12/1997 Schwab ..... 222/321.3
5,709,324 A * 1/1998 Peronnet et al. ..... 222/321.9
5,762,238 A * 6/1998 Liang ..... 222/321.9
5,769,274 A * 6/1998 Behar ..... 222/95
5,772,078 A * 6/1998 Knickerbocker ..... 222/321.1
5,947,340 A * 9/1999 Arnold et al. ..... 222/321.9
5,950,880 A * 9/1999 Garcia ..... 222/321.7
6,073,805 A * 6/2000 Gueret ..... 222/95
6,186,359 B1 * 2/2001 de Pous et al. ..... 222/1
6,186,369 B1 * 2/2001 Rosenthal ..... 222/321.7
6,253,941 B1 * 7/2001 VanBrocklin et al. ..... 215/274
6,349,856 B1 * 2/2002 Chastel ..... 222/321.7

* cited by examiner

*Primary Examiner*—David A. Scherbel
*Assistant Examiner*—Frederick C. Nicolas
(74) *Attorney, Agent, or Firm*—Wood, Phillips, Katz, Clark & Mortimer

(57) ABSTRACT

A dispenser for dispensing a fluid, the dispenser comprising a dispenser member, a container (1) with a neck (10), and a fixing member (2) for fixing the dispenser member to the neck, said fixing member forming a skirt (20) defining an inside wall (21) serving to cooperate with an outside peripheral surface (13) of the neck (10), said dispenser being characterized in that peripheral sealing means (15; 4; 5) are disposed between said inside wall (21) and said outside peripheral surface (13).

8 Claims, 2 Drawing Sheets

DISPENSER HAVING A FIXING MEMBER WITH PERIPHERAL SEALING

Figure 1A:
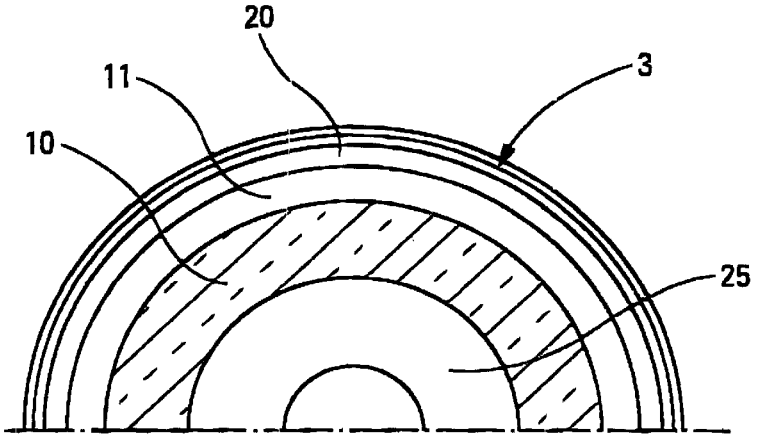

The present invention relates to a dispenser for dispensing a fluid, the dispenser comprising a dispenser member such as a pump or a valve, a container with a neck, and a fixing member for fixing the dispenser member to the neck. This type of dispenser is in frequent use in the field of pharmaceuticals, cosmetics, or perfumes for dispensing fluids, e.g. in spray form. To fix the pump or the valve to the neck of the container, a fixing member is used that is commonly designated by the term "fixing ring". In general, such a ring co-operates with the outside of the neck and is provided with a recess for receiving the body of the pump or of the valve, e.g. by snap-fastening. The fixing ring is also provided with a skirt which co-operates with the outside of the neck: the most commonly used techniques are screwing, snap-fastening, or crimping. The present invention more particularly concerns snap-fastening.

In this fixing technique (snap-fastening), it is known that the skirt of the ring can be provided either with a continuous inside snap-fastening bead, or with separate snap-fastening heads disposed at the bottom ends of snap-fastening tabs, so that the skirt is split. In general, the snap-fastening heads or the snap-fastening bead co-operate with a shoulder formed by the outside wall of the neck. A conventional design for a container neck consists in forming the top end of the neck with a reinforced outside portion that may be referred to as a "rim lip". The snap-fastening tabs or the snap-fastening bead are thus suitable for coming into engagement under the rim lip, where said lip forms a shoulder.

Naturally, it is important to provide sealing at the neck of the container in order to prevent the fluid from leaking between the neck and the fixing ring. One known technique consists in disposing a gasket at the top end of the neck, that gasket being compressed by an annular flange formed by the ring and that may be referred to as a "web". Such a gasket is omitted from certain dispensers, in which the sealing is provided directly by contact between the ring and the neck of the container. In order to obtain good sealing by direct contact, it is necessary for the neck of the container to be made of a material that is harder than the material of the ring: in general, the container is made of glass, and the ring is made of a molded plastics material. The sealing can be provided either at the top end of the neck that is in contact with the web of the ring, or at the shoulder of the rim lip. In both cases, the sealing is axial, and it is necessary to exert a strong traction or thrust force on the ring in the axial direction of the container in order to obtain the sealing. To achieve the traction or thrust, a trim band is often used that covers the fixing ring, and that serves as a thrust member to force the snap-fastening tabs and heads to come into engagement under the rim lip of the neck. Therefore, the sealing is not achieved until the trim band is mounted on the fixing ring.

An object of the present invention is to remedy the above-mentioned drawbacks of the prior art by defining a dispenser in which the fixing member provides sealing at the neck without needing to deform the skirt or the snap-fastening tabs.

To this end, the present invention provides a dispenser for dispensing a fluid, the dispenser comprising a dispenser member, a container with a neck, and a fixing member for fixing the dispenser member to the neck, said fixing member forming a skirt defining an inside wall serving to co-operate with an outside peripheral surface of the neck, in which dispenser peripheral sealing means are disposed between said inside wall and said outside peripheral surface.

Advantageously, the inside wall and the outside surface are substantially cylindrical. Since the sealing means are interposed between two surfaces that are substantially cylindrical, the sealing is radial rather than axial, as it is in the prior art. It is thus not necessary to exert a thrust or a traction force on the ring in order to obtain sealing that is effective. The sealing means thus perform two functions, namely their intrinsic sealing function, and the function of fixing means, enabling the skirt to be fastened effectively to the outside of the neck. It is thus possible to fix the ring to the neck without any snap-fastening heads or any snap-fastening bead at all. It is also possible for the neck to be formed without any reinforced portion or rim lip. Thus, the design of the ring and of the neck is much simpler.

In one embodiment, the sealing means comprise a continuous annular sealing rib formed on the outside peripheral surface of the neck and suitable for coming to bite in the inside wall of the skirt. In which case, the neck of the container is preferably made of a material that is harder than the material of the skirt of the fixing member, so that the continuous annular sealing rib penetrates into the inside wall of the skirt by causing the material of the skirt to creep therearound. In the final position, i.e. when the top end of the neck comes into contact with the web of the fixing member, the rib provides annular sealing and simultaneously fixes the skirt to the neck effectively.

In another embodiment, the inside wall of the skirt is provided with a continuous annular sealing gasket suitable for being crushed against the outside peripheral surface of the neck. Advantageously, the gasket is fixed in a recess formed by the inside wall of the skirt. In one version, the outside peripheral surface of the neck is provided with a continuous annular groove suitable for receiving the annular gasket. In another version, the neck forms an outwardly-projecting reinforced portion, said outside peripheral surface being formed by the reinforced portion, said skirt forming a snap-fastening bead suitable for coming into engagement under the reinforced portion. Preferably, the snap-fastening bead forms the bottom portion of the recess for receiving the gasket.

In all of the embodiments, the sealing means constitute fixing means for fixing the skirt to the neck.

The invention is described more fully below with reference to the accompanying drawings which give three embodiments of the present invention by way of non-limiting example.

Figure 1:
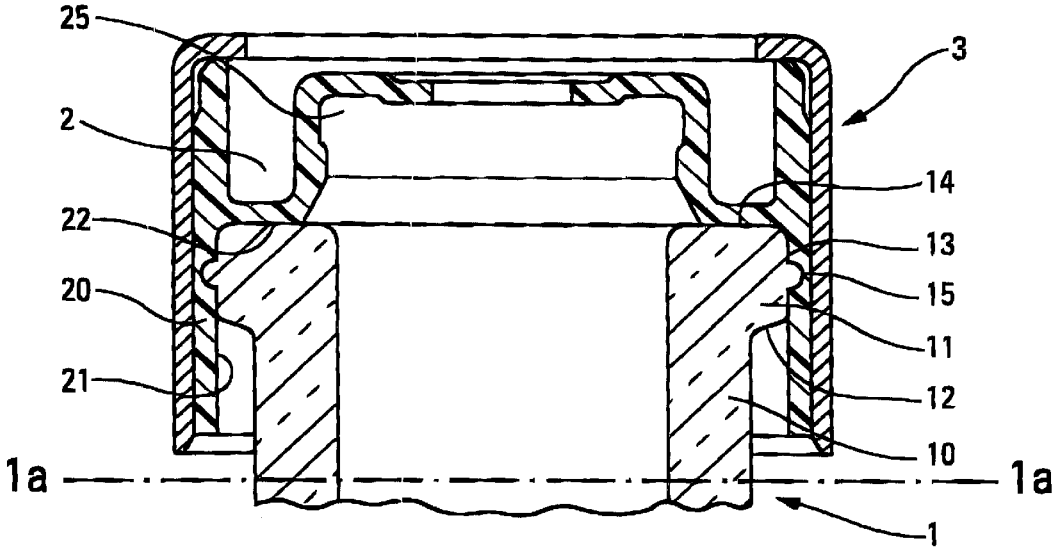
Figure 2:
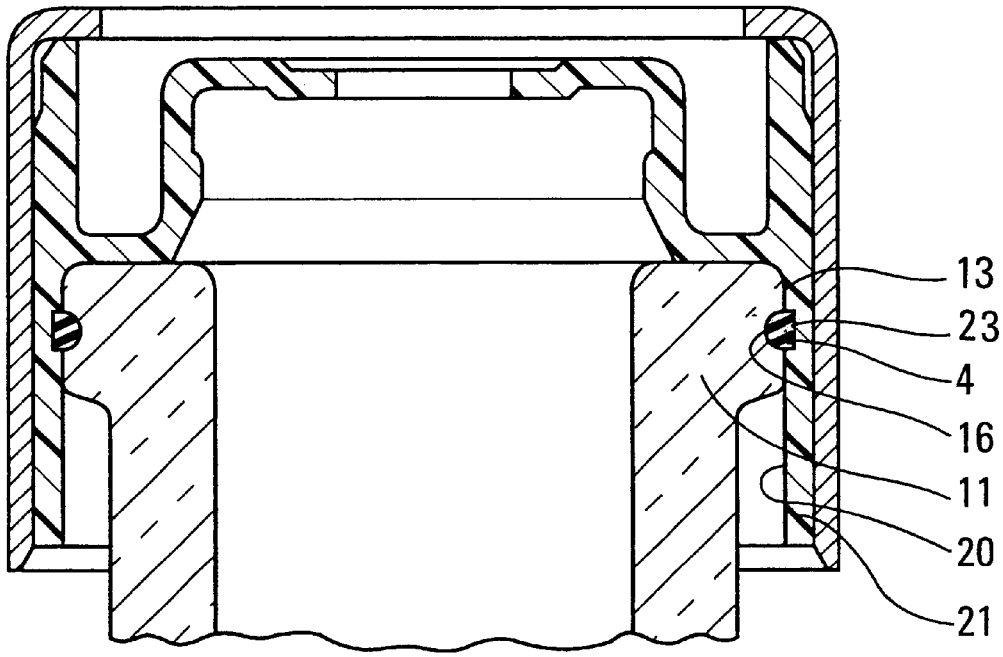
Figure 3:
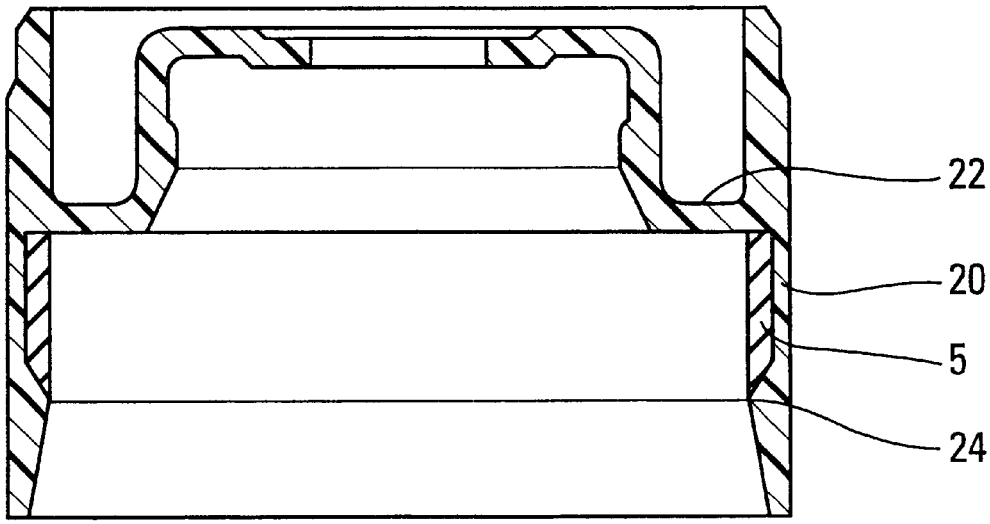

In the drawings:

FIG. 1 is a vertical cross-section view through a fixing member as mounted on a container neck in a first embodiment;

FIG. 1*a* is a horizontal section view through the fixing member shown in FIG. 1;

FIG. 2 is a vertical cross-section view through a fixing member as mounted on a neck in a second embodiment of the invention; and FIG. 3 is a cross-section view through a fixing member in a third embodiment of the present invention.

In all three of the embodiments used to illustrate the present invention, the fixing member designated by the numerical reference 2 has an overall configuration that is similar. The same applies to the neck 10 of the container 1 shown in FIGS. 1 and 2.

The fixing member 2 is in general made of a molded plastics material, and is provided with a snap-fastening recess 25 serving to receive the body of a valve or of a pump (not shown) by snap-fastening. The snap-fastening recess 25 is extended over its outside periphery by a web 22 serving to come into contact with the top end 14 of the neck 10. The outside periphery of the web 22 connects to a skirt 20 which extends downwards and which may also extend upwards as shown in the FIGS. The downwardly-extending portion of the skirt 20 has an inside wall 21 serving to co-operate with the outside surface of the neck 10. A trim band 3 covers the fixing member 2 so that it is not visible. The trim band performs a function that is purely decorative in the present invention.

The neck 10 of the container 1 shown in FIGS. 1 and 2 is of a known general type that forms a reinforced portion or "rim lip" 11 which projects radially outwards at the top end of the neck 10. The rim lip 11 has an outside peripheral surface 13 which is substantially cylindrical in shape. The rim lip also forms a shoulder 12 that interconnects the surface 13 and the portion of the neck 10 that is situated below the rim lip. This is a particular and well-known type of container neck shape. However, it is possible to use a container having a neck without a rim lip for the embodiments shown in FIGS. 1 and 2. In which case, the outside surface of the neck 10 may be completely cylindrical to its top end.

The inside wall 21 of the skirt 20 of the fixing member 2 co-operates with the outside peripheral surface 13 of the rim lip 11. The same applies to the bottom surface of the web 22 that comes into contact with the top end 14 of the neck 10.

At the rim lip, the inside wall 21 of the skirt 20 is also substantially cylindrical so that said wall and said surface 13 come into mutual contact.

In the invention, sealing means are provided at the outside peripheral surface of the rim lip 11, i.e. at the inside wall 21 of the skirt 20 at the rim lip 11.

In the embodiment shown in FIGS. 1 and 1*a*, the sealing means are in the form of a continuous annular sealing rib 15 formed by the neck on the outside peripheral surface 13 of the rim lip. This rib 15, which is shown rounded in FIG. 1, may have any profile that enables the inside wall 21 of the skirt 20 to be fastened to it effectively. For example, it is possible to consider a rib profile in the form of a catch so as to perform fixing by means of barbs. In addition, although a single rib 15 is shown in FIG. 1, it is naturally possible to consider other embodiments in which more than one rib is provided on the outside peripheral surface 13 of the rim lip.

The neck of the container is preferably made of a material that is harder than the material of the fixing member, so that the rib 15 is not deformed on mounting the fixing member 2 onto the neck. Rather, it is the inside wall 21 of the skirt 20 that is subjected to deformation, e.g. by means of the material creeping around the rib 15, in the final position shown in FIG. 1. Conventionally, the container may be made of glass and the fixing member may be made of a plastics material.

It should be noted that the rib 15 that serves as sealing means also serves as fixing means for fixing the skirt to the neck. The plastics material of which the fixing member 2 is made tends to creep around the rib 15 and to perform effective fixing at said rib. The fixing and the sealing are thus achieved by radial clamping rather than by traction or thrust, as is the case in the prior art. It is thus not necessary to provide any fixing means on the inside wall 21 of the skirt 20 below the shoulder of the rim lip 12, such as the snap-fastening heads or bead of the prior art. The ring may thus have a very simple configuration that is completely cylindrical, as may the outside wall of the neck 10. The rib 15 may be formed on a container neck that is completely cylindrical, i.e. that is not provided with a rim lip 11.

Reference is made below to FIG. 2 in order to explain a second embodiment. This embodiment differs from the preceding embodiment in that the rib 15 formed by the neck 10 is replaced by a sealing gasket 4 disposed in a recess 23 formed in the inside wall 21 of the skirt 20. Preferably, the gasket 4 is fixed in the recess 23 by any technique, such as overmolding, gluing, or force snap-fastening. The outside peripheral surface 13 of the rim lip 11 may be completely cylindrical so that the gasket 4 is crushed against the surface 13, but preferably the peripheral surface is provided with a notch 16 of shape substantially complementary to the shape of the gasket 4, so that the gasket 4 can be received inside the notch 16. Naturally, it is necessary for the gasket 4 to be slightly compressed inside the notch 16 in order for good sealing to be achieved at this level.

As in the preceding embodiment, the gasket 4 performs not only a sealing function, but also a fixing function by fitting into the notch 16. In this embodiment, it is also not necessary to provide particular fixing means on the skirt 20 under the rim lip 11. Similarly, it is not necessary for the neck of the container to be provided with a rim lip.

FIG. 3 shows a third embodiment of a fixing member. In this embodiment, the inside wall 21 of the skirt 20 is provided with a gasket 5 which extends substantially over the height of the rim lip, i.e. over the height of the outside peripheral surface 13. The skirt 20 also forms a snap-fastening bead 24 serving to come into engagement under the rim lip 11, i.e. against its shoulder 12. The gasket may be held in place in the ring by gluing, by overmolding, or by force snap-fastening. In this embodiment, the sealing is also radial, naturally thereby contributing to the fixing which is nevertheless supplemented by the presence of the snap-fastening bead 24 engaged under the rim lip 11. However, it should be noted that the engagement of the snap-fastening bead 24 does not contribute to achieving sealing at the gasket 5, as it does in the prior art. The gasket 5 performs its sealing function alone, and the snap-fastening bead 24 serves merely to supplement fixing the ring onto the neck of the container.

What is claimed is:

1. A mounting system for mounting a fluid dispensing dispenser member to a container having a neck with an outside peripheral surface, said system comprising said container, and a fixing member for fixing the dispenser member to said neck, said fixing member having a skirt defining a deformable inside wall serving to cooperate with said outside peripheral surface of said container neck, said system being characterized in that peripheral sealing means are disposed between said inside wall and said outside peripheral surface, and said sealing means comprising a continuous annular sealing rib formed on the outside peripheral surface of the neck and for deforming and biting into said skirt inside wall.

2. A mounting system according to claim 1, in which the inside wall and the outside surface are substantially cylindrical.

3. A mounting system according to claim 1, in which the sealing means constitute fixing means for fixing the skirt to the neck.

4. A mounting system for mounting a fluid dispensing dispenser member to a container having a neck with an outside peripheral surface, said system comprising said container, and a fixing member for fixing the dispenser member to said neck, said fixing member having a skirt defining an inside wall serving to cooperate with said outside peripheral surface of said neck, said system being characterized in that peripheral sealing means are disposed between said inside wall and said outside peripheral surface, and said inside wall of the skirt is provided with a continuous annular sealing gasket carried by said inside wall suitable for being crushed by said inside wall of said skirt against said outside peripheral surface of said neck.

5. A mounting system according to claim 4, in which the gasket is fixed in a recess formed by the inside wall of the skirt.

6. A mounting system according to claim 5, in which the neck forms an outwardly-projecting reinforced portion, said outside peripheral surface being formed by the reinforced portion, said skirt forming a snap-fastening bead suitable for coming into engagement under the reinforced portion.

7. A mounting system according to claim 6, in which the snap-fastening bead forms the bottom portion of the recess for receiving the gasket.

8. A mounting system according to claim 4, in which said inside wall includes an annular recess suitable for receiving said annular gasket.

* * * * *